US007354286B1

(12) United States Patent
Lee

(10) Patent No.: US 7,354,286 B1
(45) Date of Patent: Apr. 8, 2008

(54) ADAPTER FOR CONNECTORS

(75) Inventor: Chiu-San Lee, Taipei (TW)

(73) Assignee: XYZ Science Co., Ltd., Taipei (TW)

( * ) Notice: Subject to any disclaimer, the term of this patent is extended or adjusted under 35 U.S.C. 154(b) by 0 days.

(21) Appl. No.: 11/637,824

(22) Filed: Dec. 13, 2006

(51) Int. Cl.
*H01R 29/00* (2006.01)

(52) U.S. Cl. ..... 439/172; 439/131; 439/652

(58) Field of Classification Search ..... 439/171–175, 439/131, 640, 651–655
See application file for complete search history.

(56) References Cited

U.S. PATENT DOCUMENTS

| | | | | |
|---|---|---|---|---|
| 4,997,381 | A * | 3/1991 | Oh | 439/172 |
| 5,159,545 | A * | 10/1992 | Lee | 363/146 |
| 5,611,701 | A * | 3/1997 | Hahn | 439/131 |
| 5,613,863 | A * | 3/1997 | Klaus et al. | 439/131 |
| 5,628,641 | A * | 5/1997 | Hahn | 439/131 |
| 5,791,921 | A * | 8/1998 | Lee | 439/172 |
| 5,967,807 | A * | 10/1999 | Wu | 439/131 |
| 6,062,880 | A * | 5/2000 | Skuza | 439/131 |
| 6,109,977 | A * | 8/2000 | Baxter et al. | 439/693 |
| 6,126,460 | A * | 10/2000 | Wu | 439/131 |
| 6,190,184 | B1 * | 2/2001 | Cimbal et al. | 439/131 |
| 6,592,406 | B2 * | 7/2003 | Liu | 439/620.31 |
| 6,722,900 | B2 * | 4/2004 | Segawa et al. | 439/131 |
| 6,780,033 | B2 * | 8/2004 | Liu | 439/172 |
| 6,790,062 | B1 * | 9/2004 | Liao | 439/171 |
| 6,793,509 | B2 * | 9/2004 | Chen | 439/136 |
| 6,923,666 | B1 * | 8/2005 | Liao | 439/172 |
| 6,935,878 | B2 * | 8/2005 | Hsu et al. | 439/171 |
| 7,035,126 | B1 * | 4/2006 | Lanni | 363/142 |
| 7,052,298 | B1 * | 5/2006 | Cheng | 439/171 |
| 7,075,779 | B2 * | 7/2006 | Bothe et al. | 361/603 |
| 2002/0081906 | A1 * | 6/2002 | Kajiwara et al. | 439/651 |
| 2002/0127918 | A1 * | 9/2002 | Kajiwara et al. | 439/651 |
| 2004/0038572 | A1 * | 2/2004 | Liu | 439/172 |
| 2004/0097114 | A1 * | 5/2004 | Shiroshita et al. | 439/174 |
| 2005/0153587 | A1 * | 7/2005 | Hsu et al. | 439/171 |
| 2006/0110963 | A1 * | 5/2006 | Cheng | 439/171 |

FOREIGN PATENT DOCUMENTS

| | | |
|---|---|---|
| TW | 430166 | 4/2001 |
| TW | 445671 | 7/2001 |
| TW | 456634 | 9/2001 |

* cited by examiner

*Primary Examiner*—Ross Gushi
(74) *Attorney, Agent, or Firm*—Birch, Stewart, Kolasch & Birch, LLP

(57) ABSTRACT

An adapter for connectors to couple connectors and power supply sockets of different specifications to establish electric connection between them includes two terminal sets that are insertable into the power supply sockets. The two terminal sets are pivotally coupled on one end of the adapter in an opposite open manner, and are held in a housing trough formed on the adapter in normal conditions. When in use desired terminals can be inserted into a corresponding power supply socket of a selected specification and raised upright. The terminal sets can be retracted and extended so that the size of the adapter is smaller. Such a design also can keep the terminals from extending to prevent hurting people or articles.

21 Claims, 16 Drawing Sheets

ADAPTER FOR CONNECTORS

BACKGROUND OF THE INVENTION

1. Field of the Invention

The present invention relates to an adapter for connectors and particularly to an adapter for connectors that has coupling terminals of different specifications.

2. Brief Discussion of the Related Art

Adapter for connectors is an indispensable article in international traveling. It provides basic connector conversion for electric products to allow a connector and a socket of different specifications to establish electric connection so that the electric products can get power supply. Reference patents and products are available on the market. Some of them are credited to the Applicant as briefed in the following R.O.C. patent publication No. 430166 discloses a global socket equipped with a specification-enabled fast assembly structure. It allows sockets with different insertion ports of varying countries to be coupled on a socket anchor seat which has one or more coupling ports formed thereon. Therefore a socket suitable for a specific country can be assembled quickly to connect to power supply. The socket mainly has a base bottom with metal pin connection element located thereon that has a screw hole or jack. Each metal pin connection element is coupled with two conductive brackets and a grounding bracket in the socket. The screw hole can be engaged quickly with a conductive element which has a screw thread to channel electricity into the socket. Moreover, the socket can be quickly wedged in a socket anchor seat which has an upper shell and a base that has at least one coupling port formed thereon. The base and the upper shell corresponding to the coupling port have respectively one or more clipping terminal that can be fastened to the conductive element on the bottom of the socket in an integrated manner. The clipping terminal is wedged in a plurality of anchor frame rims formed on the base. The base and the upper shell are interposed by a safety spacer. The safety spacer and each set of clipping terminal have respectively apertures corresponding to each other to be run through by the conducive elements on the bottom of the socket. By means of such a design the socket of different ports of varying countries can be wedged in each coupling port of the socket anchor seat so that the conductive element on the socket bottom can run through the apertures of the safety spacer and fastened to the clipping terminal at the base to become integrated, and power supply can be channeled to the socket to support various types of power supply connectors. The socket also has elastic chips on two sides to allow the socket to be quickly latched on each coupling port of the socket anchor seat. The design of the safety spacer can keep the energized clipping terminal from being touched when the socket is not yet coupled to provide safety protection.

R.O.C. patnet publication No. 445671 discloses a universal adapter with a fast replaceable insertion port face panel. The insertion port face panel is located on a socket or adapter that has universal insertion ports. The insertion port face panel can be configured with different insertion ports according to varying countries and can be replaced quickly to form a socket or adapter with required insertion ports. The face panel of the socket or adapter has preset insertion ports of different specifications of varying countries to receive connectors. The socket or adapter has a frame with a flange of a desired height on the periphery of the insertion ports. There is a recess zone in the frame to be coupled with the face panel of different insertion ports. The face panel has one or more elastic strut on the bottom side to be inserted into one insertion port for anchoring when it is installed in the recess. Thereby the insertion port conforming to one specification is formed. The insertion port face panel can be removed and replaced by another insertion face panel of different insertion ports to achieve fast replacement as desired. Thus the socket or adapter can be altered quickly to equip with insertion ports of a desired specification.

R.O.C. patent publication No. 456634 discloses a simple universal adapter mainly based on Germany connector specifications. The adapter has a face panel and a body that are formed in an integrated manner by injection. It has housing portions on two sides each has a universal conductive rack. In a housing portion located in the center, there is a grounding rack formed by a single clipping board. The body has at least one latching flange on the periphery of one end. A terminal board is provided that has a latch notch on the corresponding periphery. To install the terminal board, first, the latch flange of the body is inserted into the latch notch of terminal board, then the terminal board is swiveled to latch the flange on the latch notch thereby the terminal board and the body can be quickly coupled together or removed for replacement. The body has two symmetrical sides forming Germany grounding troughs each has a grounding blade. The grounding blade has one side connecting to the grounding rack. After the body is inserted into the insertion trough of a Germany socket, the grounding blade is connected to a grounding reed. The adapter can also be inserted into a socket of French specifications. The terminal board has an anchor position formed at a selected diagonal angle after it is swiveled against the insertion ports of the face panel. The conductive rack has an extension portion. After the terminal board is swiveled at the selected diagonal angle on the anchoring position, the distal end of the terminal and the extension portion of the conductive rack maintain a contact condition. Moreover, the terminal board has a grounding port corresponding to a grounding strut of the French socket that is located on one side of a grounding port formed on the adapter face panel at a skewed angle. Hence when the adapter is inserted into a French socket, the grounding strut can be inserted through the grounding port of the terminal board to be in contact with an arched contact located on one side of the corresponding grounding blade in the body to form a grounding effect. Such a design has a simpler structure and can be fabricated and assembled quickly at a lower cost. It also may serve as a general adapter and adaptable to the sockets of French and Germany specifications. The universal adapter thus formed has a simpler structure and enhanced function.

The patents set forth above allow users to alter the connector to suit the local socket specifications during international traveling to get electric power for electric products. Although the adapters provide adequate function, and can be altered instantly to suit the socket, the size has to be increased to accommodate multiple functions. This becomes a heavy burden to the users during travel. To provide multiple functions at a smaller size of adapter is a technique known in the Applicant. In addition, as the Germany and French sockets have a safety design formed in a concave trough, the present universal connector adapters have to provide a corresponding connector to mate the concave trough that cannot be shared with other insertion terminals (because of too short of the terminals). All these issues are still pending to be resolved in the industry.

SUMMARY OF THE INVENTION

Therefore the primary object of the present invention is to solve the aforesaid disadvantages. The present invention provides an adapter for connectors that has two sets or more of insertion terminals to be selectively inserted in to a socket of a corresponding specification. The two sets of insertion terminals are pivotally coupled on the adapter in an opposite open manner to reduce the spaced occupied by multiple sets of insertion terminals and allow one set of insertion terminals to be selectively raised in an upright manner to be inserted into a mating socket. The insertion terminals also are retractable in a housing trough of the adapter in a retracting condition to reduce the space occupied by the entire adapter to facilitate carrying during travel.

Another object of the invention is to prevent the insertion terminals from scraping people or goods. The two insertion terminals are located in the housing trough formed on the adapter without extending outside, thus do not cause damage.

Yet another object of the invention is to increase adaptability of the adapter. The insertion terminal is coupled with an extension member which is adjustable in length. Hence the adapter can mate the Germany and French sockets that have a trough to obtain power supply without falling short in length.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
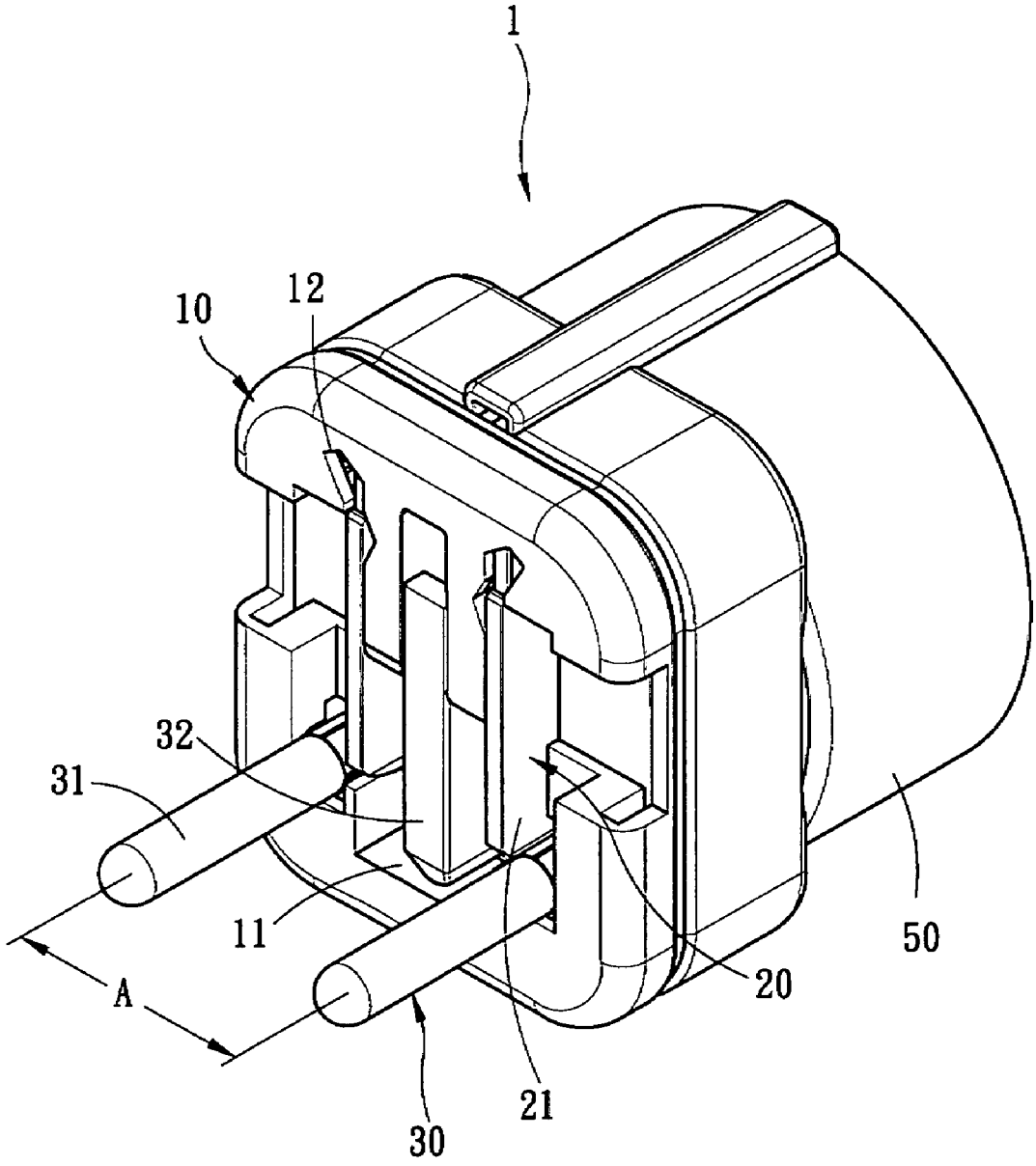
FIGS. 1 through 4 are various perspective views of the invention.
Figure 5:
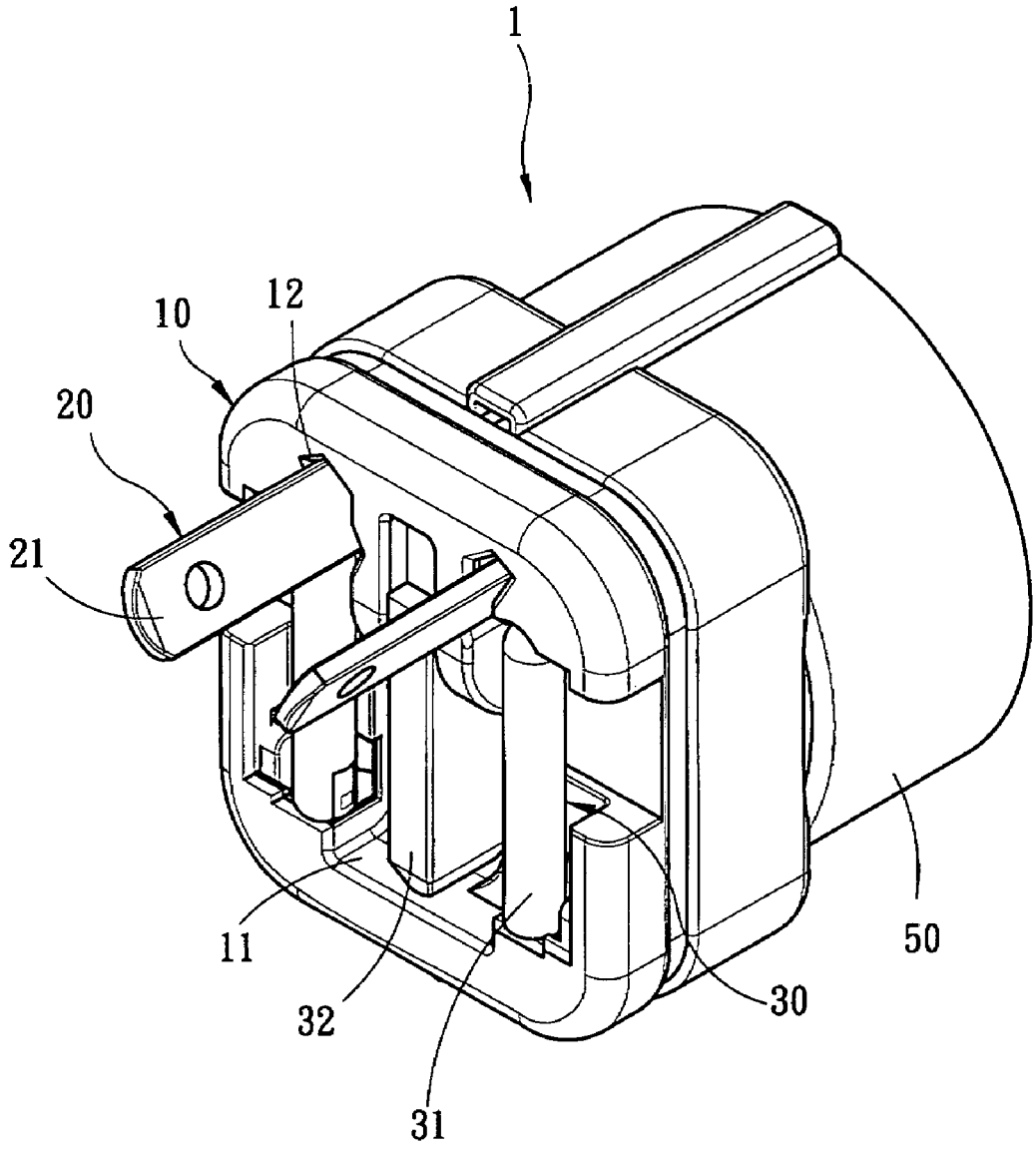
FIG. 5 is a perspective view of another embodiment of the invention.

Please refer to FIGS. 1 through 6 for an embodiment of the invention. The adapter 1 for connectors of the invention aims to couple connectors and a socket of different specifications and establish electric connection between them. The adapter 1 has an insertion side 50 which has a plurality of coupling ports 51 (also referring to FIG. 8) to be inserted by conductive terminals of a connector and a coupling side 10 which has a first terminal set 20 and a second terminal set 30 located thereon corresponding to a mating socket (not shown in the drawings). The coupling side 10 further has a housing trough 11 to house the two terminal sets 20 and 30 which are pivotally coupled on two opposing ends of the housing trough 11 and can be extended and retracted in an opposite open manner. When the adapter 1 is in a use condition one set of terminals corresponding to a socket specification can be selectively swiveled upright onto the coupling side 10 (as shown in FIGS. 1 and 5 with different types of terminal sets being selected) to facilitate insertion into the socket. When the adapter 1 is retracted, the two terminal sets 20 and 30 can be held in the housing trough 11 without extending outside the coupling side 10 (referring to FIG. 12). Thus the adapter 1 can be widely used to hold terminal sets of different specifications to mate the corresponding sockets.

Figure 6:
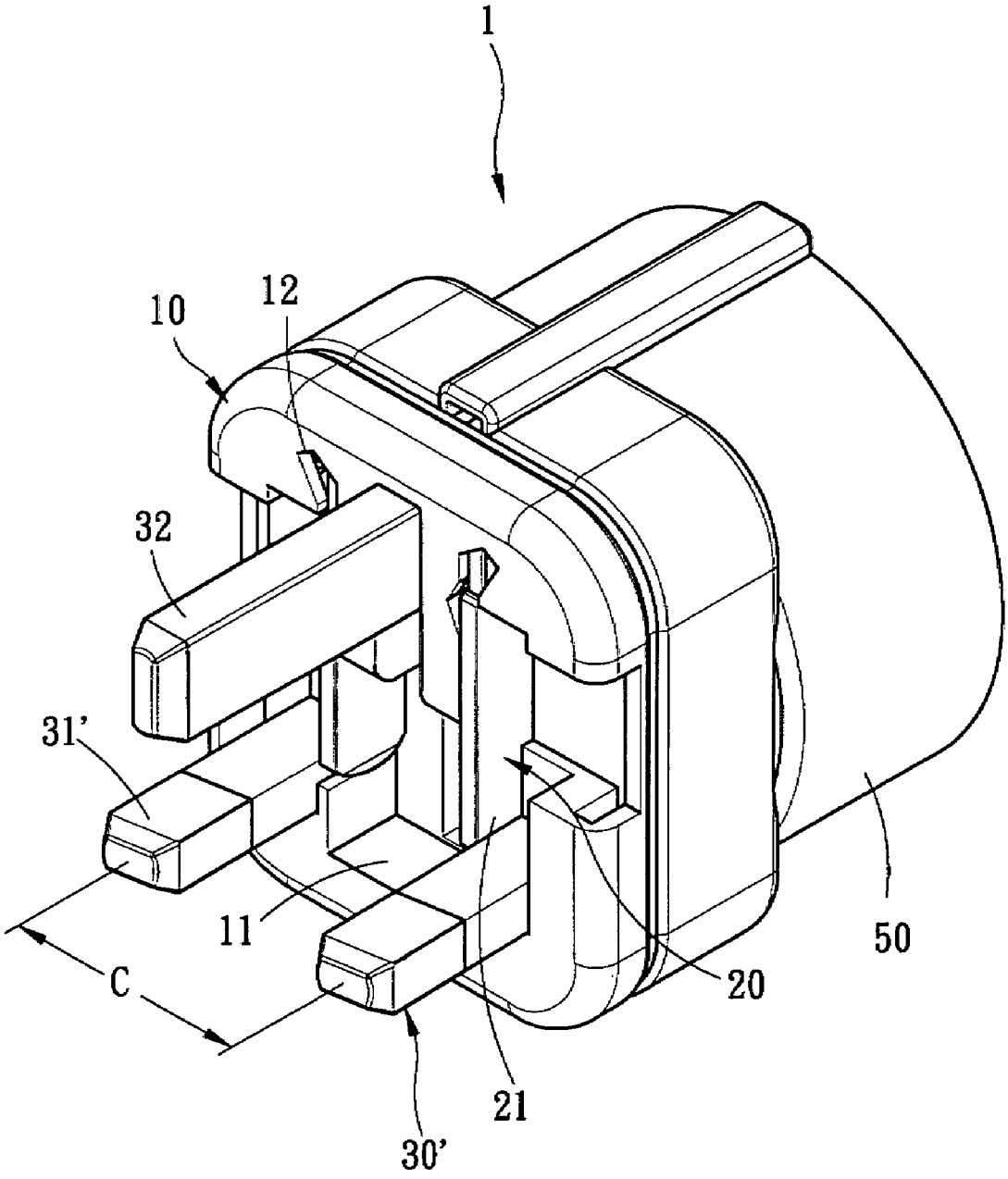
FIG. 6 is a perspective view of yet another embodiment of the invention.
Figure 12:
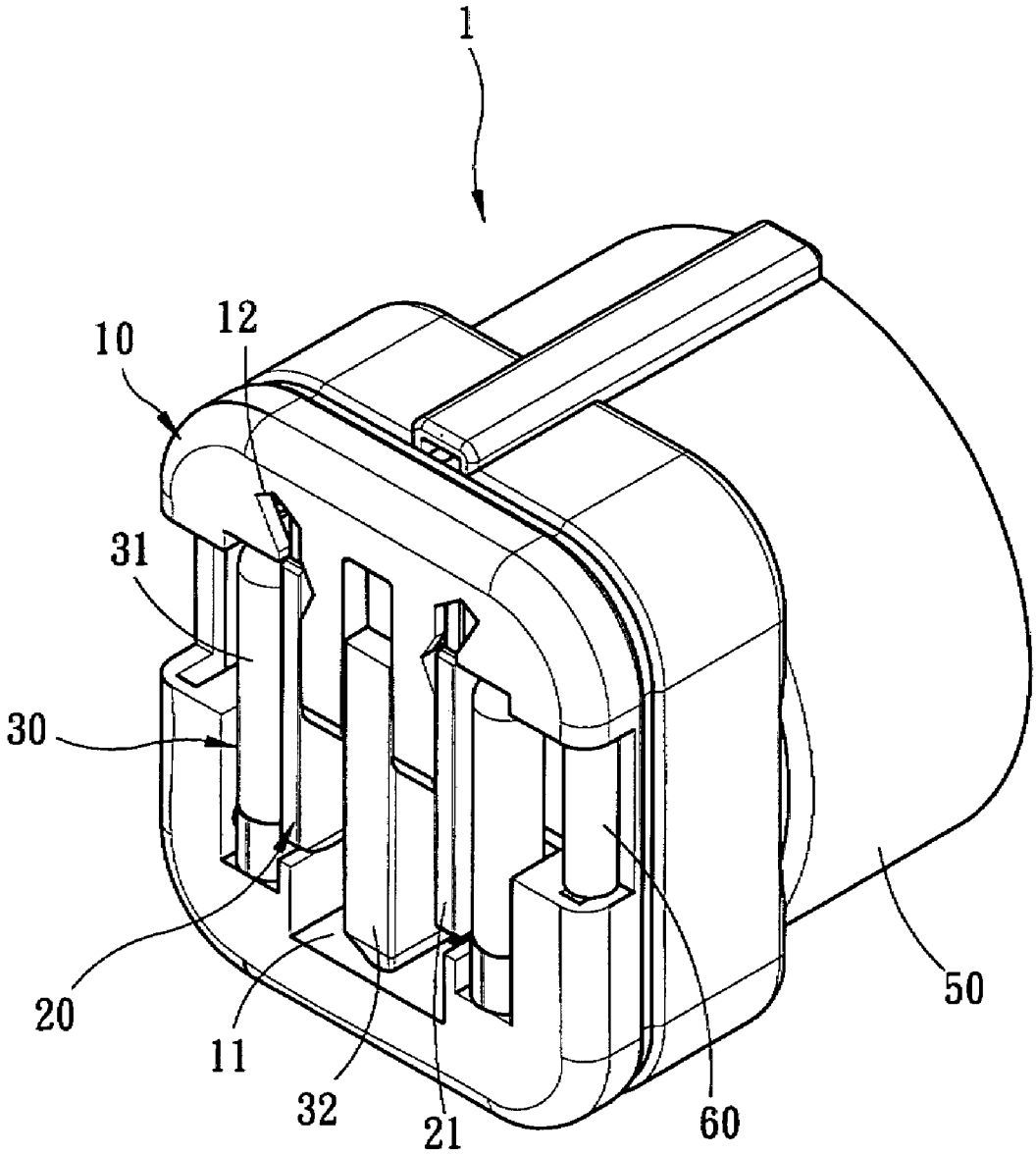
FIG. 12 is a schematic view of another embodiment of the invention.

The first and second terminal sets 20 and 30 previously discussed include respectively U.S. type flat terminals 21 and European type round terminals 31 that serve as examples. In this embodiment the terminals 21 and 31 are spaced at different intervals with a second interval B of the U.S. type flat terminals 21 smaller than a first interval A of the European type terminals 31. Hence the U.S. type flat terminals 21 can be mounted within the first interval A of the European round terminals 31 without interfering each other. In the retracting condition, the two terminal sets 20 and 30 are retracted and held in the housing trough 11 without extending outside the coupling side 10. Thus the adapter 1 occupies a smaller space and also does not scrape and hurt people or articles (as shown in FIG. 12). When in use, referring to FIGS. 1 and 2, the first terminals set 20 or the second terminal set 30 can be selectively inserted into a mating socket to get electric power from the socket of varying specifications. The invention is not limited to adopt European type terminals 31. As shown in FIG. 6. The second terminal set 30' may also include British type square terminals 31' spaced at a third interval C greater than the second interval B of the U.S. type terminals. Or the European type terminals 31 may also be replaced by the British type square terminals 31'.

Figure 2:
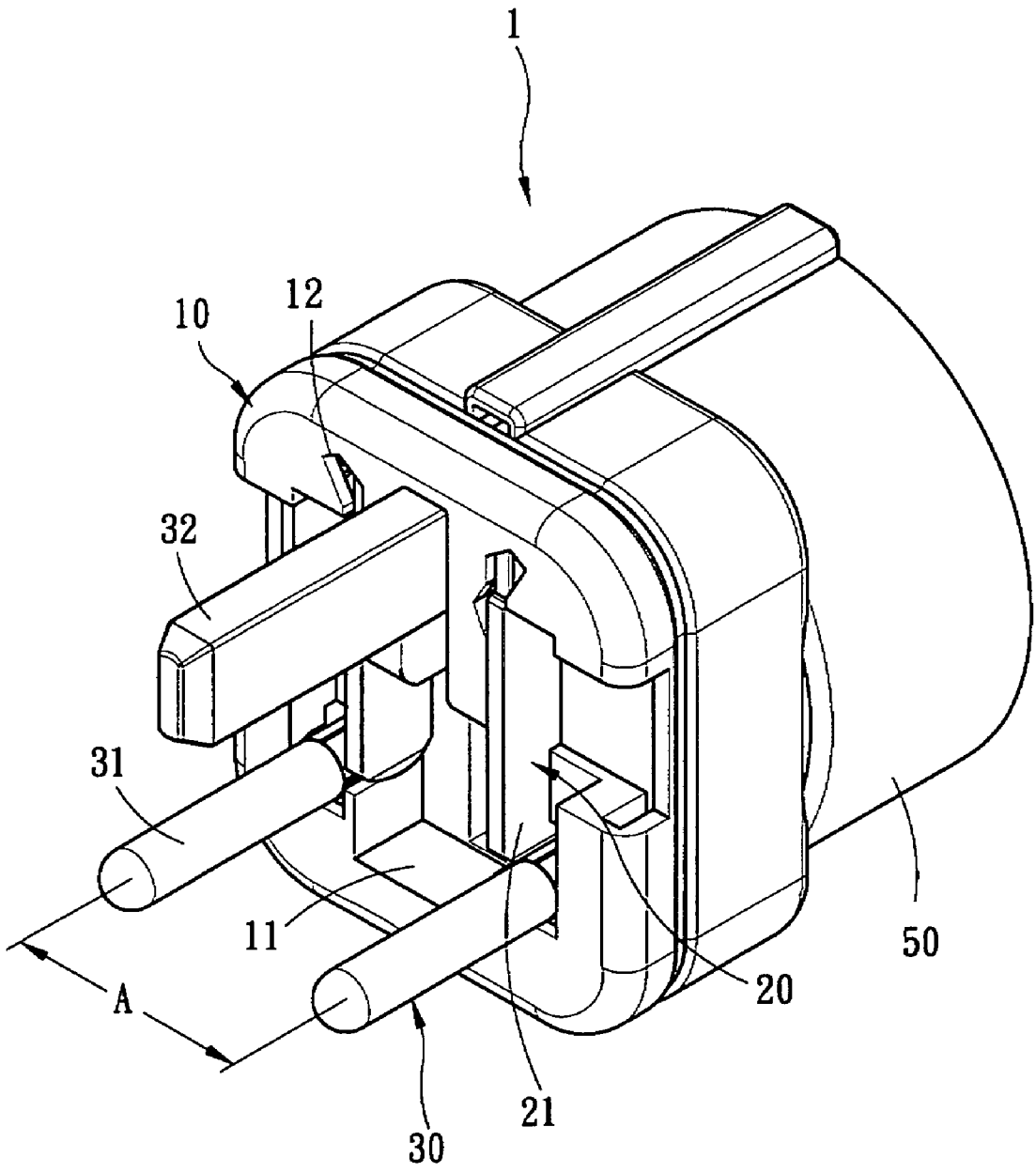
Figure 3:
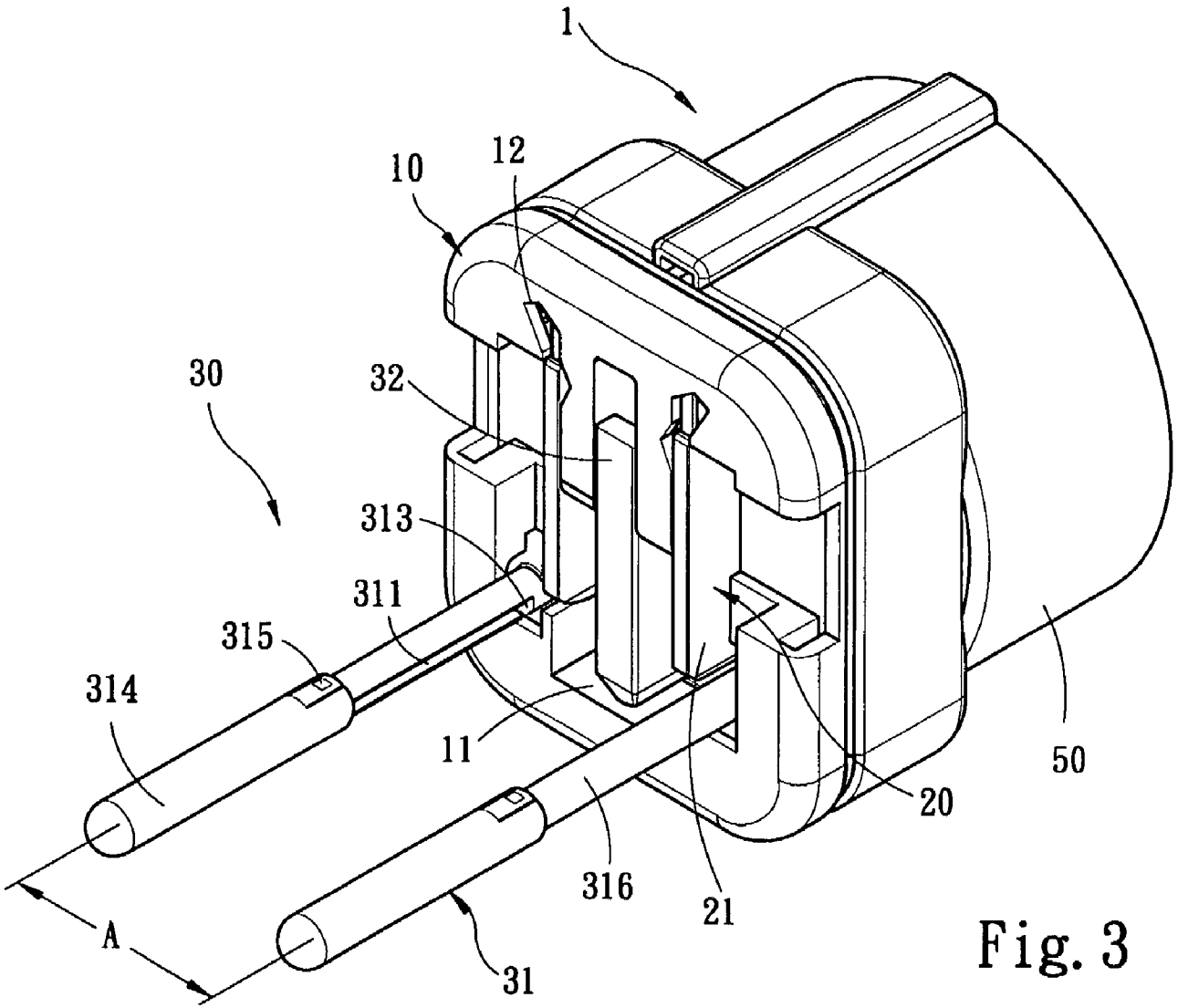
Figure 4:
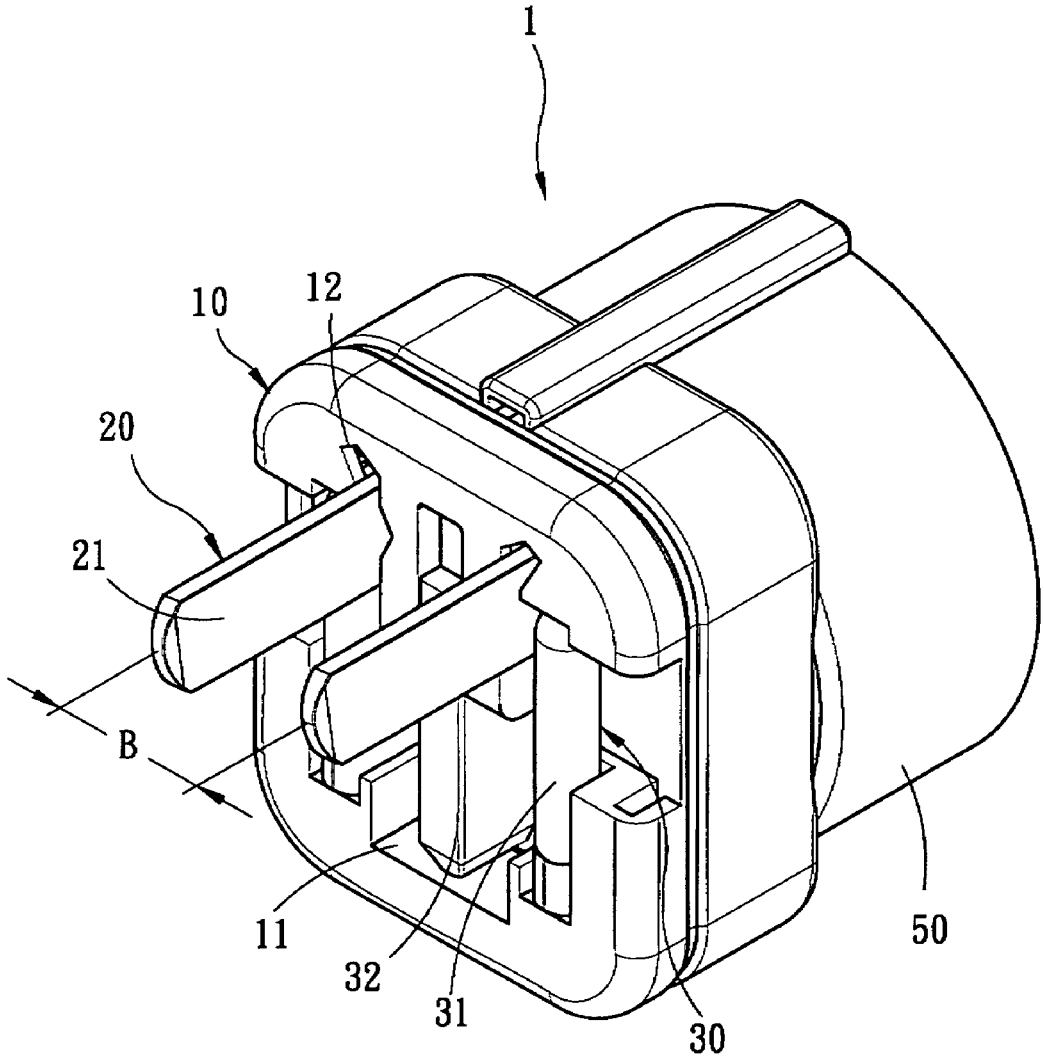

Moreover, in response to safety factors and different connector regulations of varying countries, sockets in many countries have a grounding port to hold a grounding end, such as England. Thus the adapter 1 may also include a grounding terminal 32 as shown in FIG. 2. The grounding terminal 32 is hinged on a selected location in the housing trough 11 without extending outside the coupling side 10, and can be swiveled upright onto the coupling side 10 when in use to be inserted into a corresponding ground port on the socket.

Referring to FIG. 2, a British type socket has a grounding port as a safety measure. Before the grounding terminal 32 is inserted the corresponding terminals 31 cannot get electric power from the socket. Through the grounding terminal 32 of the invention, even if the European type round terminals 31 are formed on the adapter 1, once the grounding terminal 32 is raised upright the European round terminals 31 can get electric power from a British type socket. The grounding terminal 32 may be made from insulation materials of or conductive materials, but is not necessary to be conductive and grounded. As long as the safety measure in the British type socket is opened, the terminals 31 can be inserted into the socket to get electric power.

Figure 7:
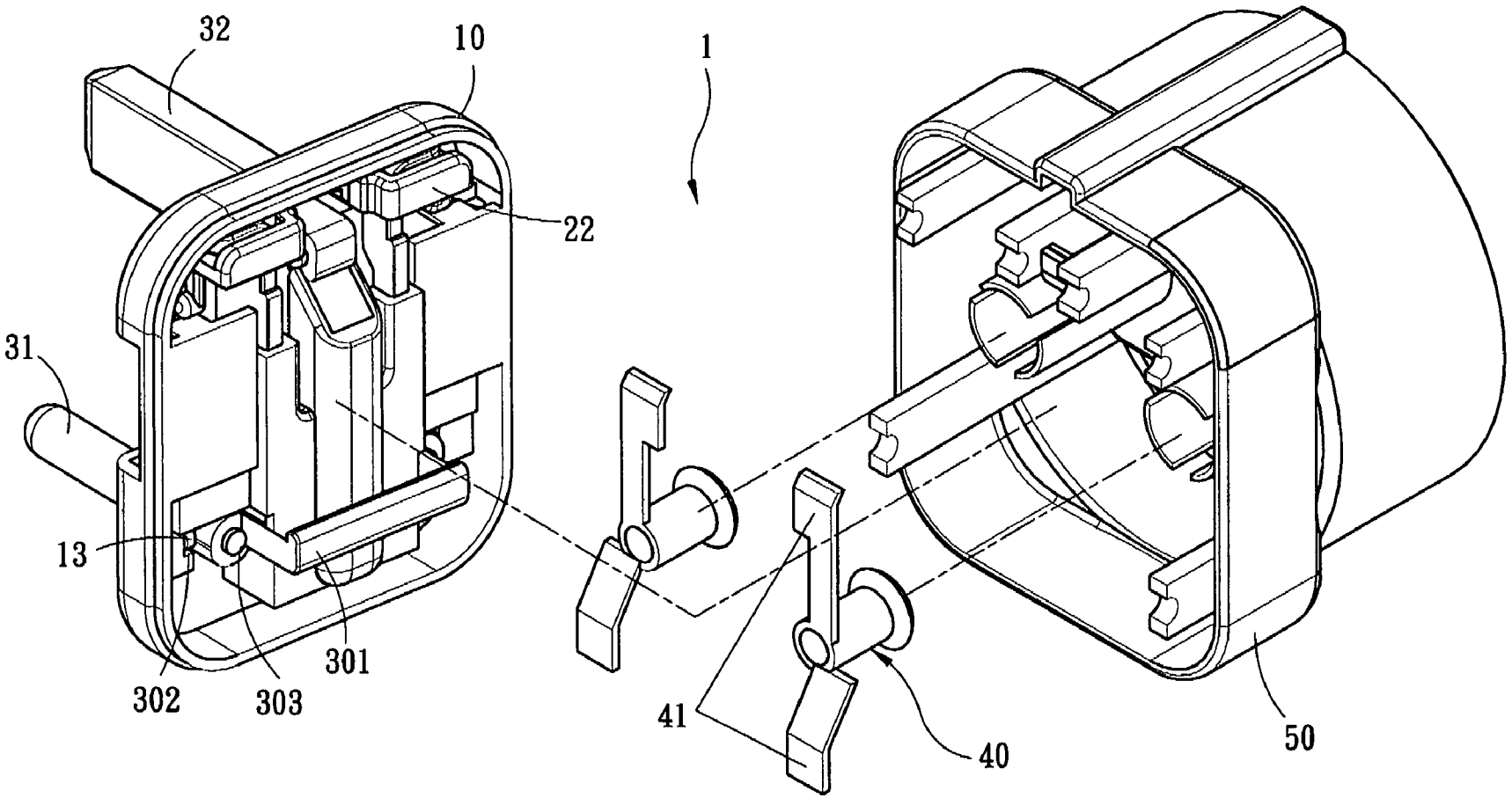
FIGS. 7 and 8 are exploded views of the invention.
Figure 8:
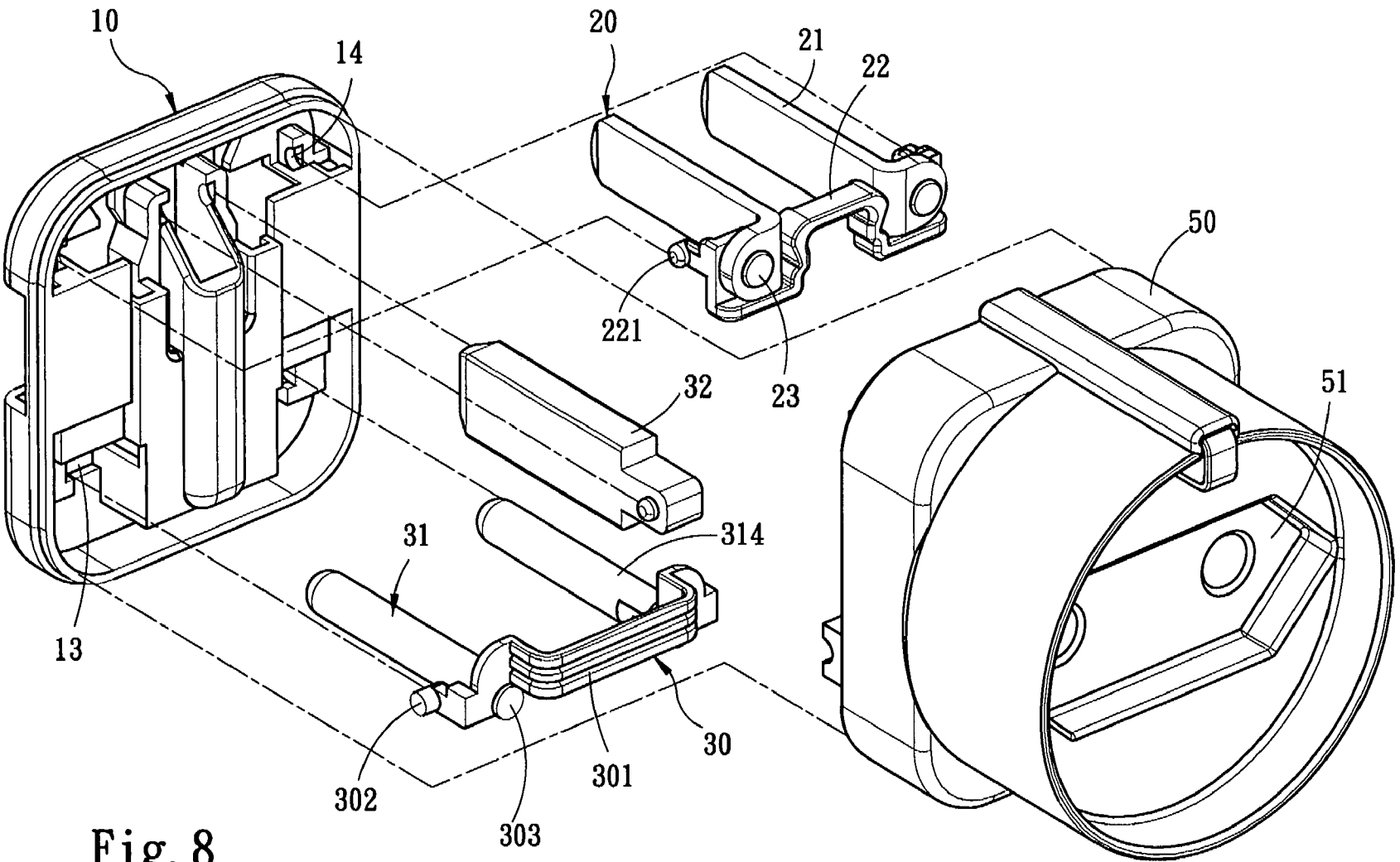

Referring to FIGS. 7 and 8, the adapter 1 has two sets of terminals 21 and 31 and a conductive member 40 which forms electric connection with a conductive terminal on a connector. The conductive member 40 has two contact ends 41 extending to the two terminal sets 20 and 30. In the use condition when the terminals 21 and 31 are in the upright condition, one terminal set is in contact with the contact ends 41 to establish electric connection with the connector.

Referring to FIG. 8, the first terminal set 20 is anchored on an insulation terminal seat 22 through an anchor member 23. The terminal seat 22 has a pair of first stub shafts 221 on two sides. The coupling side 10 has guiding tracks 14 on inner ends corresponding to the first stub shafts 221 for the first stub shafts 221 to swivel thereabout. Hence when the first terminal set 20 is in the upright and use condition, the first stub shafts 221 can be swiveled in the guiding tracks 14 and anchored. The flat terminals 21 form electric connection with the conductive terminal of the connector through the conductive member 40.

The second terminal set 30 is located on an insulation linkage bar 301 on one end of the adapter 1 to form a connection end 303 in contact with the contact end 41. The linkage bar 301 has two second stub shafts 302 on two sides. The coupling side 10 has rotation troughs 13 on an inner end corresponding to the second stub shafts 302. Hence the second terminal set 30 can be swiveled through the second stub shafts 302 and the rotation troughs 13 to an upright and use condition, or be retracted.

Figure 9:
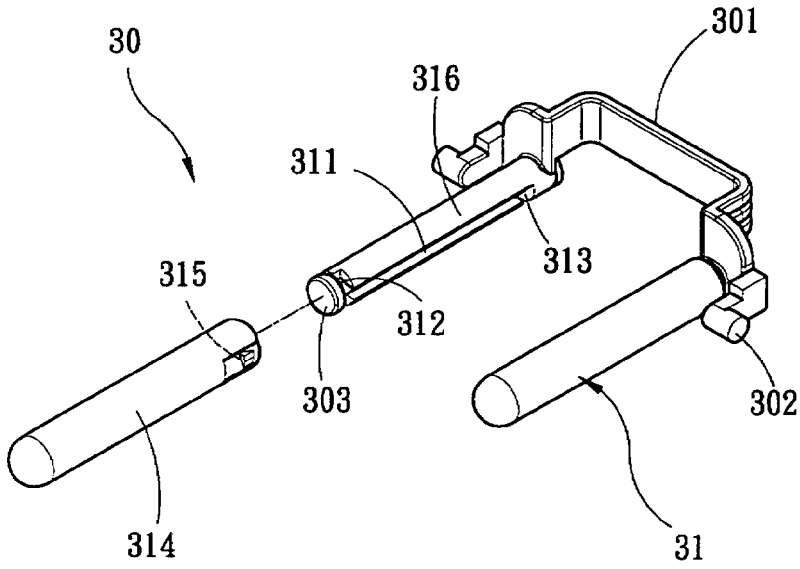
FIG. 9 is a fragmentary exploded view of the invention.
Figure 10:
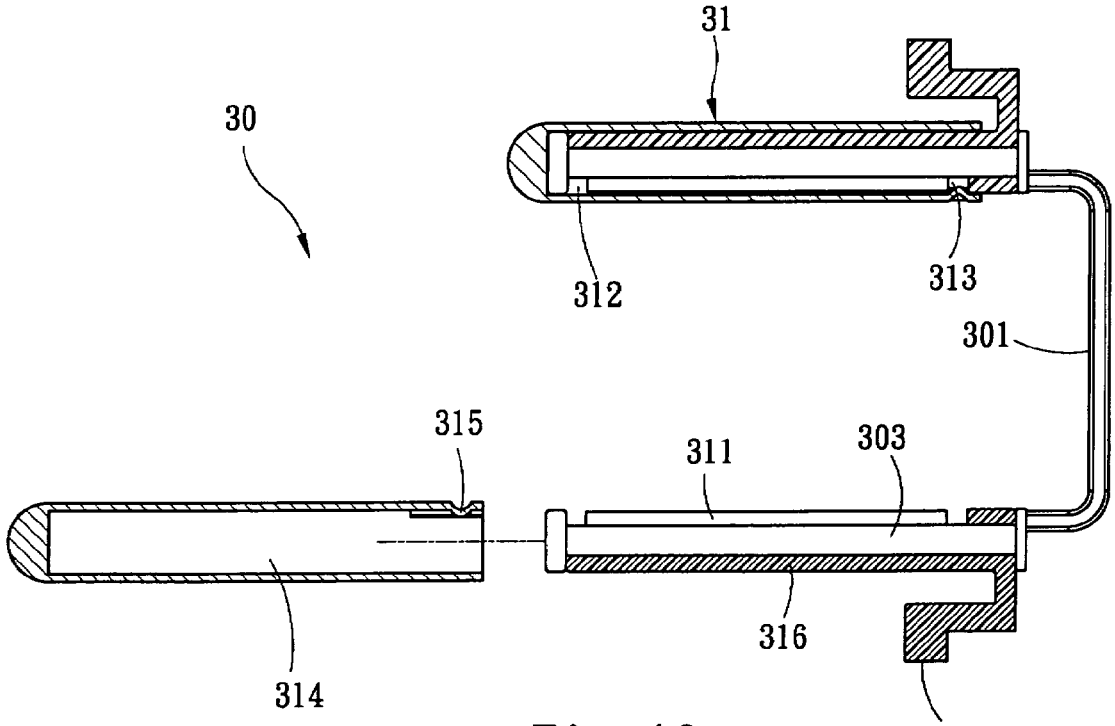
FIG. 10 is a fragmentary sectional view of the invention.
Figure 11A:
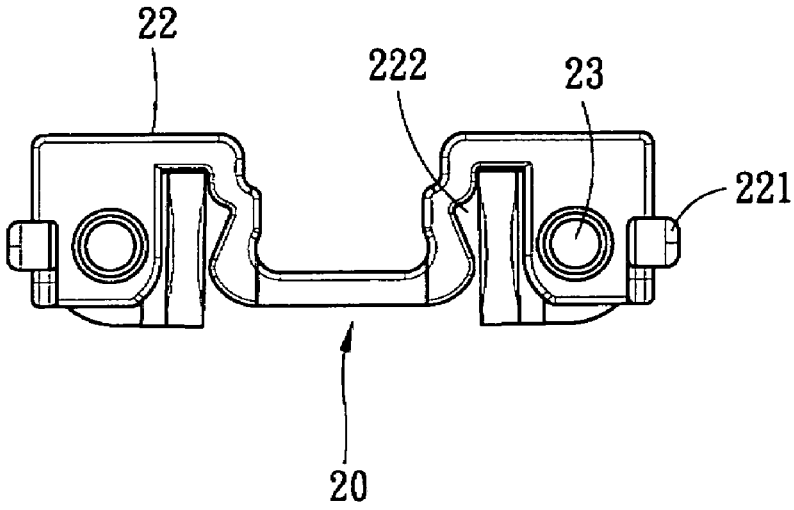
FIGS. 11A and 11B are fragmentary schematic views of the invention in operating conditions.
Figure 11B:
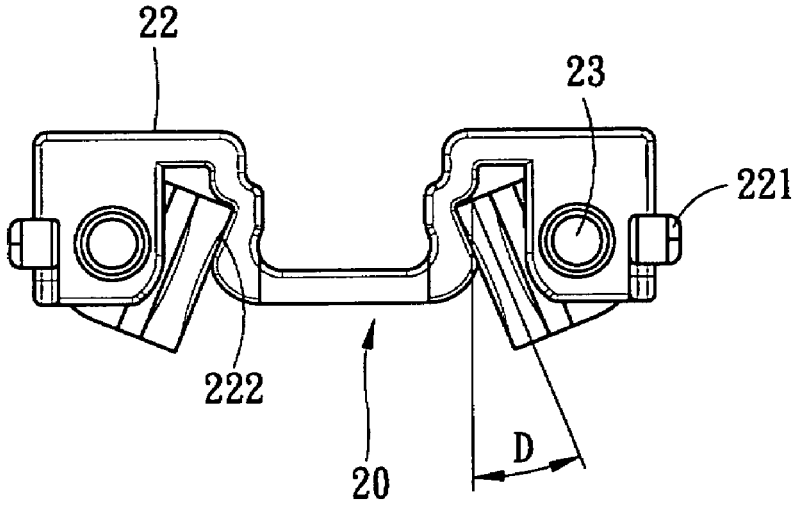
Figure 13:
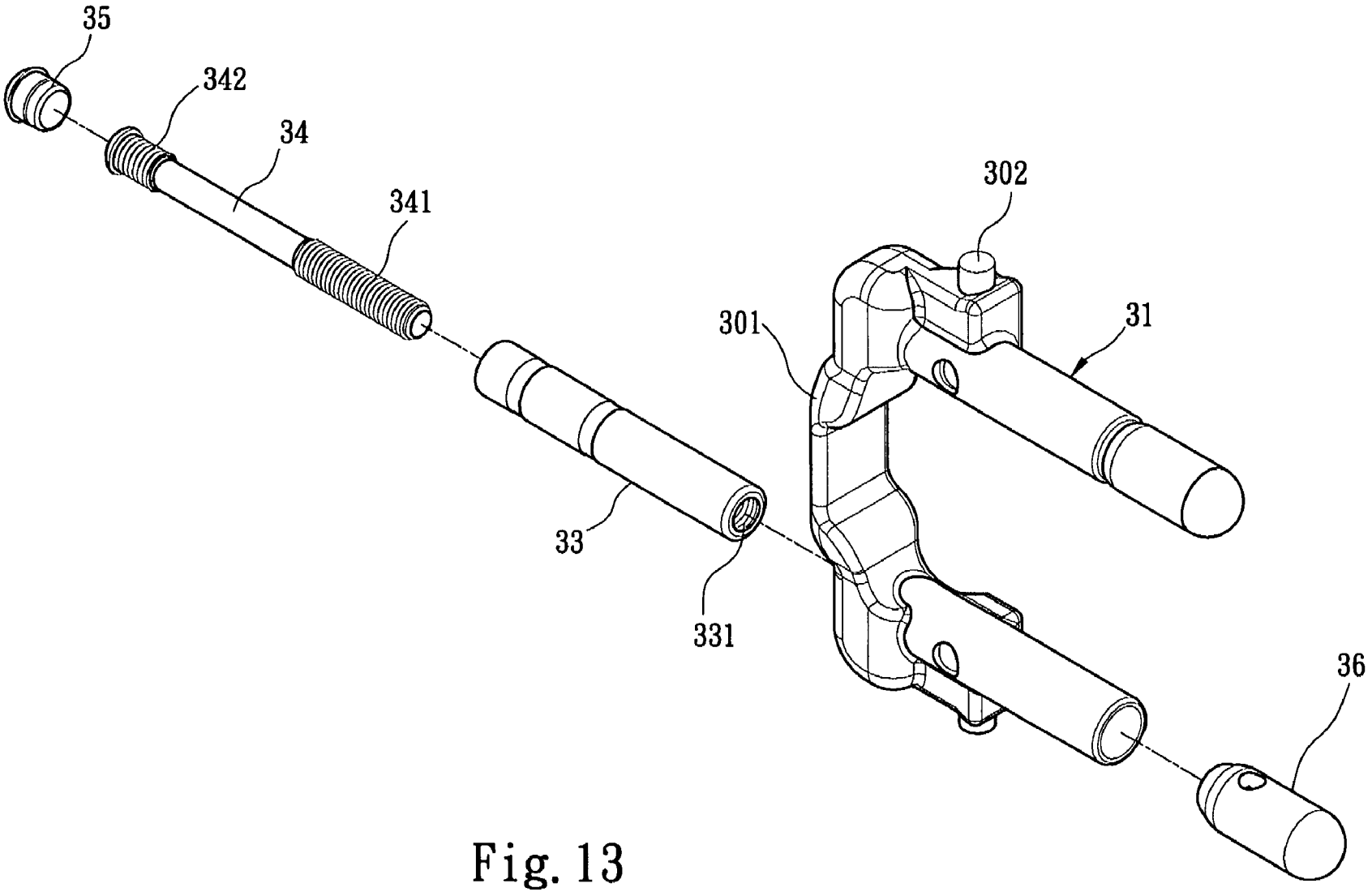
FIG. 13 is a schematic view of another embodiment of the insertion terminal of the invention.
Figure 14:
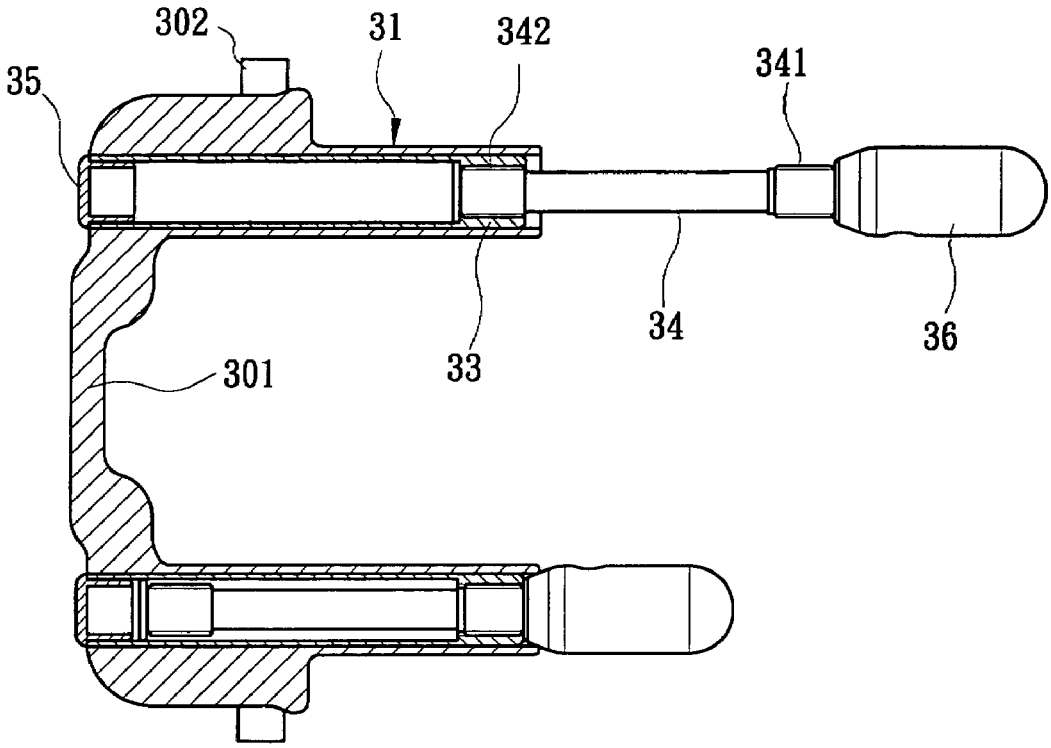
FIG. 14 is a sectional view of another embodiment of the insertion terminal of the invention.

Referring to FIGS. 9 and 10, in the event that the second terminal set 30 has the European round terminals 31 formed thereon, each of the round terminals 31 is coupled with an extension member 314 which has hollow one end which has a boss 315 formed thereon. The round terminal 31 is covered by an insulation layer 316 which has a sliding flute 311 allowing the boss 315 to slide thereon. The sliding flute 311 has a first latch cavity 312 and a second latch cavity 313 on a front end and a bottom end to latch the boss 315 to anchor the extension member 314 at the front end and bottom end to form a first anchor position and a second anchor position, and also form electric connection with the round terminals 31. Such a structure aims to adjust the length of the round terminals 31. For instance, when the invention is adopted to be used on a Germany or French socket (not shown in the drawings), as the socket has a safety trough, and the insertion ports are formed on the bottom side of the safety trough, the round terminals 31 of the adapter 1 to be coupled with the socket can be adjusted at a greater length to offset the gap formed between the coupling side and the insertion ports. In short, the design of the round terminals 31 has the following main features: the second anchor position of the boss 315 is corresponding to the insertion ports of the ordinary plane of the socket, and the boss 315 is latched in the second latch cavity 313 to allow the extension member 314 to be anchored at the second anchor position, hence the round terminals 31 can be inserted securely into the insertion ports of the ordinary plane of the socket without loosening off. In response to the insertion requirement of the Germany or French socket, to avoid the round terminals 31 from being too short, the boss 315 can be moved away from the second latch cavity 313 and slid on the sliding flute 311 to the front end of the round terminal 31 and latched in the first latch cavity 312 so that the extension member 314 can be anchored at the first anchor position. And the round terminals 31 can be inserted into the Germany or French socket through the extension member 314 to get electric power. Refer to FIGS. 13 and 14 for another embodiment of round terminals 31 and extension member 34. The extension member 34 has two ends forming respectively a threaded portion 341 and 342. The round terminal 31 is hollow to be coupled with a conductive member 33 of the extension member 34 inside. The extension member 34 has a terminal head 36 on one end and a sealing member 35 on other end sealing the hollow round terminal 31. The conductive member 33 has another threaded portion 331 on an inner wall corresponding to the extension member 34 so that the extension member 34 can be slid to the first anchor position and the second anchor position to engage the threaded portion 341 or 342 with the another threaded portion 331 for anchoring. Also refer to FIGS. 5, 11A and 11B for an Australian socket on which the insertion port is formed at a diagonal angle D and at a size mating the U.S. type flat terminal 21. To enhance applicability of the adapter 1, when the first terminal set 20 is in a use condition, the anchor member 23 of the first terminal set 20 is anchored on the terminal seat 22 and swivelable about the first stub shafts 221 so that the first terminal set 20 can be moved to make the flat terminals 21 tilted to mate the Australian socket. The coupling side 10 and the terminal seat 22 have respectively a notch 12 and 222 tilted at the diagonal angle D to hold the tilted and flat terminals 21.

Figure 15:
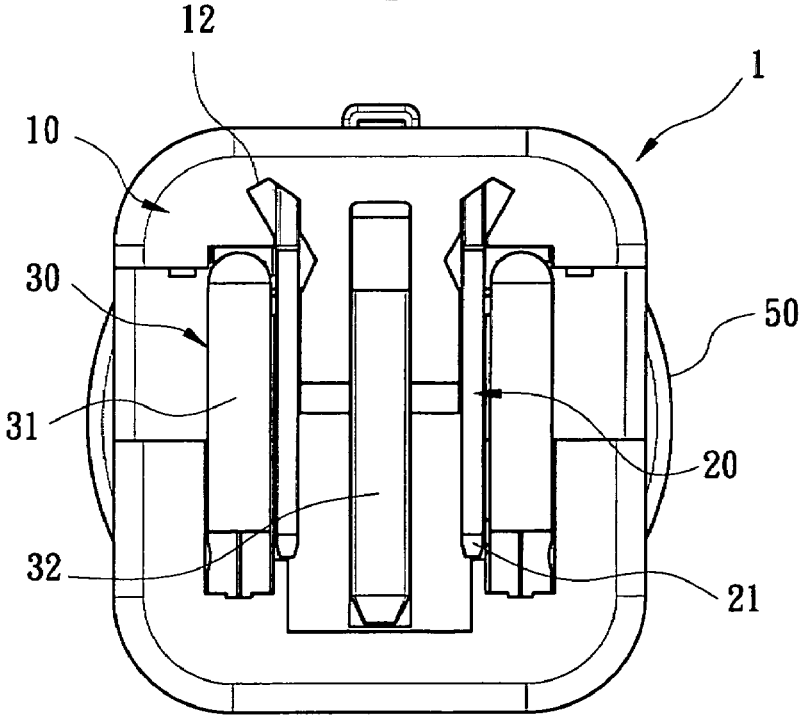
FIG. 15 is a front view of the adapter of the invention.
Figure 16:
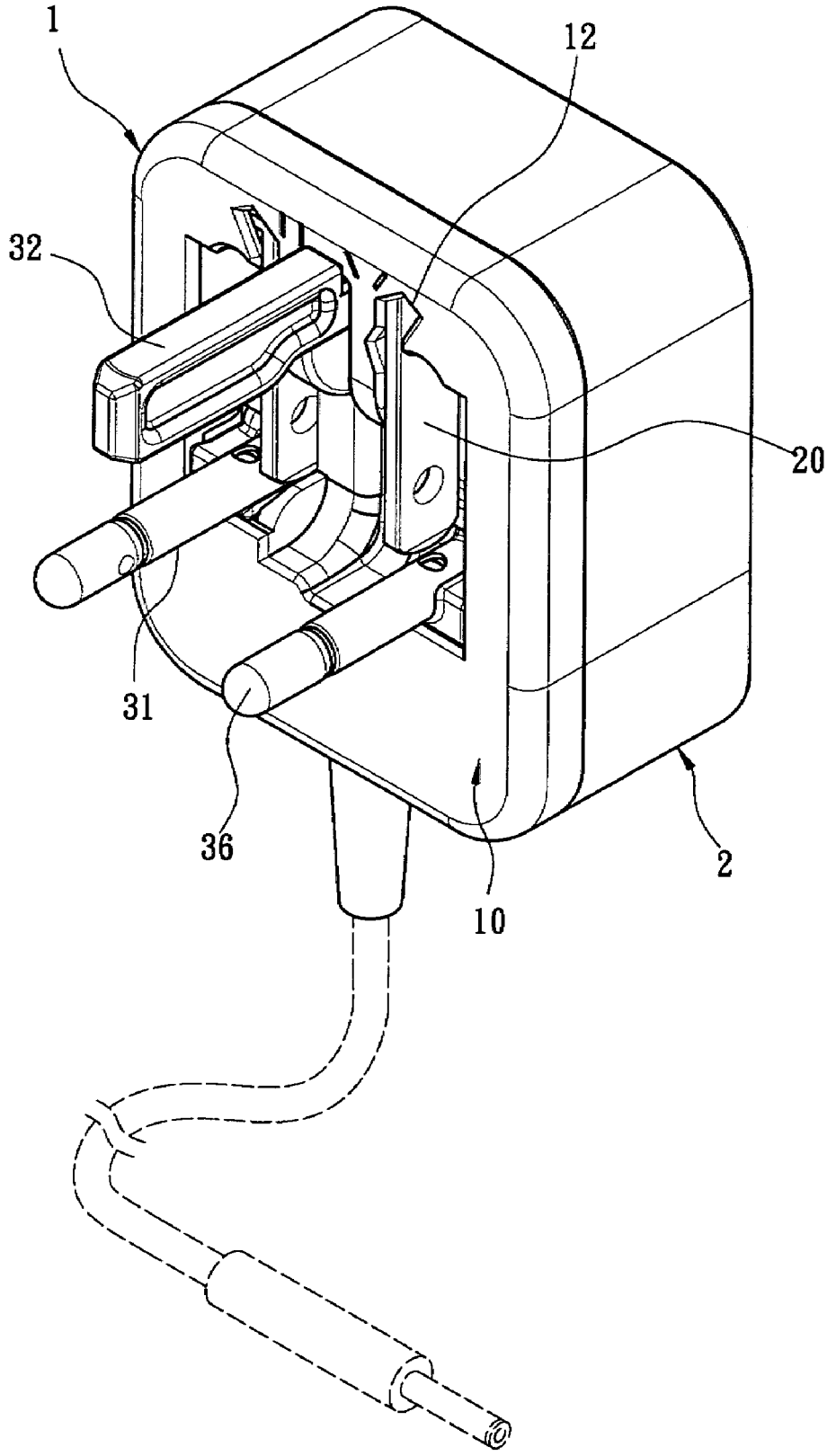
FIG. 16 is a schematic view of the invention used on a transformer.
Figure 17:
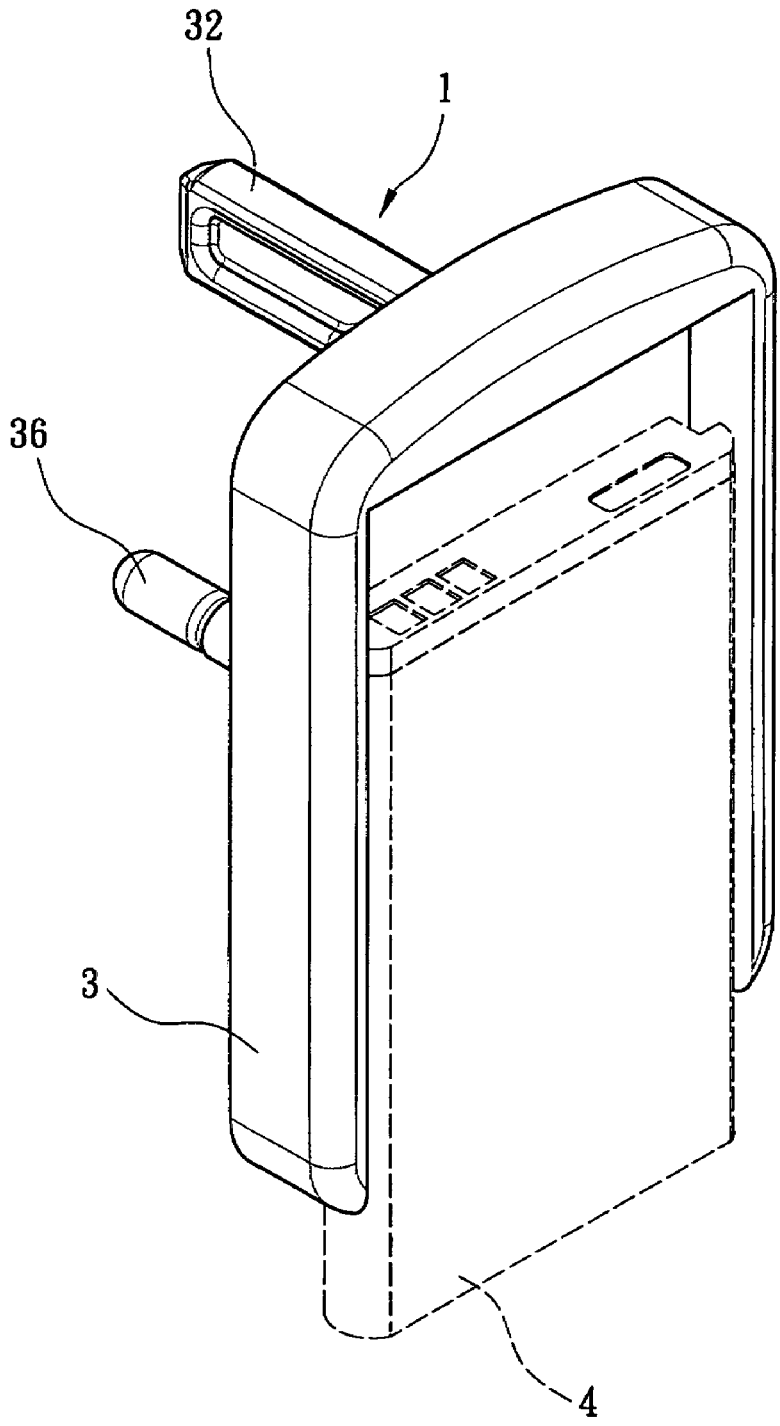
FIG. 17 is a schematic view of the invention used on a handset charging dock.
Figure 18:
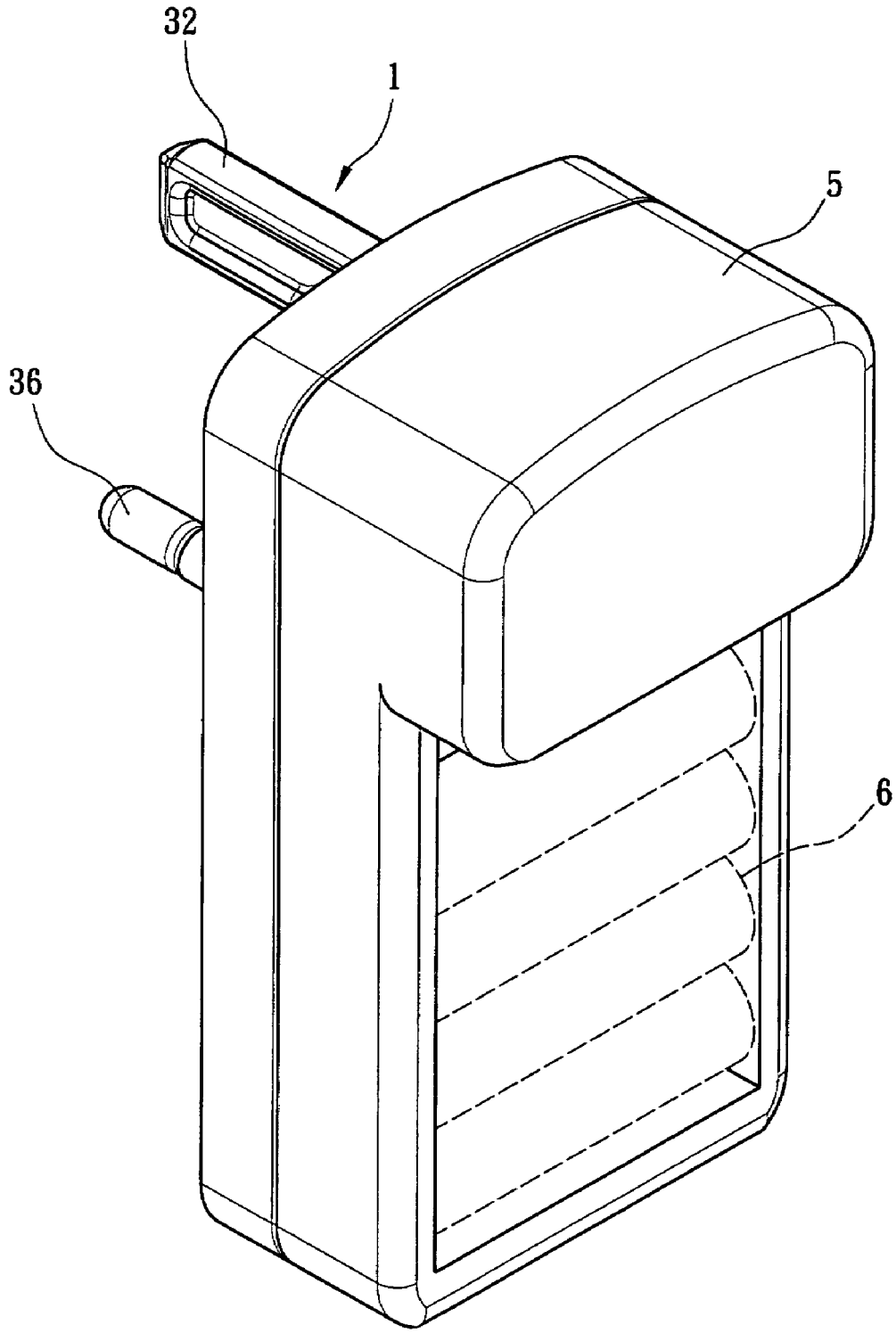
FIG. 18 is a schematic view of the invention used on a charger.

Refer to FIGS. 12 and 15 for another embodiment of the invention with the adapter 1 in a retracted condition. The first and second terminal sets 20 and 30 are retracted in the housing trough 11 without extending outside the coupling side 10, thus can reduce the total size of the adapter 1, and do not scrape or hurt people or articles. To meet safety concern of using electricity, the coupling side 10 further has a fuse 60 located thereon (this is an optional feature and may be omitted according to actual requirements) to prevent current overshoot and burning out of electric devices. The applicability of the invention is extensive. For instance, the adapter 1 can be used on a transformer 2 (referring to FIG. 16), or to be coupled with a handset charging dock 3 (to charge a handset battery 4, referring to FIG. 17), or coupled with a charger 5 (to charge a chargeable battery 6, referring to FIG. 18). Thus people who travel or do business in different countries can respond to the socket specifications of main countries to couple electronic products with the sockets of those countries when in use.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An adapter for establishing an electrical connection between connectors and sockets of different specifications, the adapter having an insertion side with a plurality of ports for insertion of conductive terminals of the connectors and a coupling side for insertion into the sockets, comprising:

a housing trough located on the coupling side in an indented manner; and a first terminal set and a second terminal set, each set having terminals of different specifications, and each terminal having a pivotable base which moves the terminal between an open and a retracted position, whereby the pivotable bases for the first and second terminal sets are located on opposite sides of the housing trough so that the first and second terminals move in a direction crosswise to one another, whereby the terminal sets are held in the housing trough when in a retracted condition, and whereby either terminal set can be inserted into a corresponding socket when in an open position, wherein the first terminal set and the second terminal set include respectively flat parallel blade terminals and round parallel pin terminals, wherein the coupling side has a rectangular grounding terminal pivotally coupled on a desired location to allow the round parallel pin terminals to be inserted into a socket with three insertion ports, and wherein the rectangular grounding terminal is made from an insulation material.

2. The adapter of claim 1, further having a conductive member with contact ends which extend twoards the first terminal set and the second terminal set, such that when either the first terminal set or the second terminal set is in an open position, contact is made between the utilized terminal set and one contact end of the conductive member, so as to form an electrical connection.

3. The adapter of claim 1, wherein the terminals of the first terminal set and the second terminal set are respectively mounted onto an insulation terminal seat and an insulation linkage bar, the terminal seat and the linkage bar having stub shafts on two sides, the stub shafts being pivotally coupled on the guiding tracks and on the rotation troughs formed on the coupling side, respectively.

4. The adapter of claim 3, wherein the coupling side and the terminal seat each have a notch to allow the flat parallel blade terminals to be swiveled at a diagonal angle to become flat diagonal blade terminals.

5. The adapter of claim 1, wherein the round parallel pin terminals are coupled respectively with an extension member which is slidable onto the terminals and anchored at a first anchor position and a second anchor position to form electrical connection with the round parallel pin terminals.

6. The adapter of claim 5, wherein the extension member is hollow and has an opening on one end with a boss formed thereon, the opening being coupled on the terminal and covered by an insulation layer, the insulation layer having a sliding flute to allow the boss to slide thereon, the sliding flute having a first latch cavity and a second latch cavity on a front end and a bottom end thereof, respectively, to allow the boss to be latched in the first latch cavity or the second latch cavity and anchored on a front end or a bottom end of the terminal, so as to form an electrical connection.

7. The adapter of claim 5, wherein the extension member has two ends each having a threaded portion, the terminal is hollow to couple with a conductive member of the extension member, and the conductive member has another threaded portion on an inner wall corresponding to and being engageable with the extension member to form the first anchor position and the second anchor position.

8. The adapter of claim 1, wherein the coupling side has a replaceable fuse to prevent current overshoot.

9. The adapter of claim 1, wherein the terminals of the first terminal set and the second terminal set are respectively mounted onto an insulation terminal seat and an insulation linkage bar, the terminal seat and the linkage bar having stub shafts on two sides, the stub shafts being pivotally coupled on the guiding tracks and on the rotation troughs formed on the coupling side, respectively.

10. The adapter of claim 9, wherein the coupling side and the terminal seat each have a notch to allow the flat parallel blade terminals to be swiveled at a diagonal angle to become flat diagonal blade terminals.

11. An adapter for establishing an electrical connection between connectors and sockets of different specifications, the adapter having an insertion side with a plurality of ports for insertion of conductive terminals of the connectors and a coupling side for insertion into the sockets, comprising:

a housing trough located on the coupling side in an indented manner; and a first terminal set and a second terminal set, each set having terminals of different specifications, and each terminal having a pivotable base which moves the terminal between an open and a retracted position, whereby the pivotable bases for the first and second terminal sets are located on opposite sides of the housing trough so that the first and second terminals move in a direction crosswise to one another, whereby the terminal sets are held in the housing trough when in a retracted condition, and whereby either terminal set can be inserted into a corresponding socket when in an open position, wherein the first terminal set and the second terminal set include respectively flat parallel blade terminals and round parallel pin terminals, and wherein the round parallel pin terminals are coupled respectively with an extension member which is slidable onto the terminals and anchored at a first anchor position and a second anchor position to form electrical connection with the round parallel pin terminals.

12. The adapter of claim 11, further having a conductive member with contact ends which extend towards the first terminal set and the second terminal set, such that when either the first terminal set or the second terminal set is in an open position, contact is made between the utilized terminal set and one contact end of the conductive member, so as to form an electrical connection.

13. The adapter of claim 11, wherein the extension member is hollow and has an opening on one end with a boss formed thereon, the opening being coupled on the terminal and covered by an insulation layer, the insulation layer having a sliding flute to allow the boss to slide thereon, the sliding flute having a first latch cavity and a second latch cavity on a front end and a bottom end thereof, respectively, to allow the boss to be latched in the first latch cavity or the second latch cavity and anchored on a front end or a bottom end of the terminal, so as to form an electrical connection.

14. The adapter of claim 11, wherein the extension member has two ends each having a threaded portion, the terminal is hollow to couple with a conductive member of the extension member, and the conductive member has another threaded portion on an inner wall corresponding to and being engageable with the extension member to form the first anchor position and the second anchor position.

15. The adapter of claim 11, wherein the coupling side has a replaceable fuse to prevent current overshoot.

16. The adapter of claim 11, wherein the coupling side has a rectangular grounding terminal pivotally coupled on a desired location to allow the round parallel pin terminals to be inserted into a socket with three insertion ports.

17. The adapter of claim 16, wherein the rectangular grounding terminal is made from an insulation material.

18. An adapter for establishing an electrical connection between connectors and sockets of different specifications, the adapter having an insertion side with a plurality of ports for insertion of conductive terminals of the connectors and a coupling side for insertion into the sockets, comprising:

a housing trough located on the coupling side in an indented manner; and a first terminal set and a second terminal set, each set having terminals of different specifications, and each terminal having a pivotable base which moves the terminal between an open and a retracted position, whereby the pivotable bases for the first and second terminal sets are located on opposite sides of the housing trough so that the first and second terminals move in a direction crosswise to one another, whereby the terminal sets are held in the housing trough when in a retracted condition, and whereby either terminal set can be inserted into a corresponding socket when in an open position, wherein the first terminal set and the second terminal set include respectively flat parallel blade terminals and rectangular prong terminals, the rectangular prong terminals further including a grounding terminal pivotally coupled on a desired location of the coupling side, wherein the rectangular grounding terminal is made from an insulation material.

19. The adapter of claim 18, further having a conductive member with contact ends which extend towards the first terminal set and the second terminal set, such that when either the first terminal set or the second terminal set is in an open position, contact is made between the utilized terminal set and one contact end of the conductive member, so as to form an electrical connection.

20. The adapter of claim 18, wherein the terminals of the first terminal set and the second terminal set are respectively mounted onto an insulation terminal seat and an insulation linkage bar, the terminal seat and the linkage bar having stub shafts on two sides, the stub shafts being pivotally coupled on the guiding tracks and on the rotation troughs formed on the coupling side, respectively.

21. The adapter of claim 18, wherein the coupling side and the terminal seat each have a notch to allow the flat parallel blade terminals to be swiveled at a diagonal angle to become flat diagonal blade terminals.

* * * * *